United States Patent [19]

Leibhard et al.

[11] 4,352,442

[45] Oct. 5, 1982

[54] DEVICE FOR THE MELTING AND MEASURED DISCHARGE OF A THERMOPLASTIC ADHESIVE MATERIAL

[75] Inventors: Erich Leibhard, Munich; Hanno Richter, Unterhaching; Gusztav Lang; Franz Popp, both of Munich; Heinz Goellnitz, Ottobrunn, all of Fed. Rep. of Germany

[73] Assignee: Hilti Aktiengesellschaft, Fürstentum, Liechtenstein

[21] Appl. No.: 123,416

[22] Filed: Feb. 21, 1980

[30] Foreign Application Priority Data

Feb. 26, 1979 [DE] Fed. Rep. of Germany ..... 2907484

[51] Int. Cl.[3] ..... B67D 5/62

[52] U.S. Cl. ..... 222/146 HE; 219/422

[58] Field of Search ..... 222/146 R, 146 H, 146 HE; 219/230, 421, 422–425

[56] References Cited

U.S. PATENT DOCUMENTS 3,377,012 4/1968 Cushman ..... 222/146 HE
3,612,357 10/1971 Ruskin ..... 222/146 HE
3,758,001 9/1973 Callan ..... 222/146 HE
3,951,308 4/1976 Thirtle ..... 222/146 HE X
4,150,770 4/1979 Wieland et al. ..... 222/146 HE

*Primary Examiner*—Joseph J. Rolla
*Attorney, Agent, or Firm*—Toren, McGeady & Stanger

[57] ABSTRACT

In a device for the melting and measured discharge of a thermoplastic adhesive material, a melting chamber is enclosed by a heating coil. The adhesive material in solid rod form is supplied into the melting chamber through a sealing sleeve formed of a material such as polytetrafluoroethylene (TEFLON). A heating element is mounted on the bearing sleeve adjacent the melting chamber to heat up the sleeve and the material within it to a desired temperature. A switch or other member is connected to the heating element on the sleeve for discontinuing its supply of heat to the sleeve when the desired temperature is reached. The part of the sealing sleeve on the opposite side of the heating element from the melting chamber can be provided with some structure to dissipate or block the flow of heat through the sealing sleeve away from the melting chamber.

12 Claims, 3 Drawing Figures

1
2
3
4
5
6
7
8
9
10
11
II
II 5
18
18a
19
20
21
22
7
6

DEVICE FOR THE MELTING AND MEASURED DISCHARGE OF A THERMOPLASTIC ADHESIVE MATERIAL

SUMMARY OF THE INVENTION

The present invention is directed to a device for the melting and measured discharge of a thermoplastic adhesive material and includes a melting chamber with the heating coils arranged around the melting chamber, and a sealing sleeve positioned at the inlet end of the melting chamber.

Thermoplastic adhesive materials are finding increased use because of their advantages, such as fast load-bearing capacity, the lack of damaging or harmful solvents and clean processing. Such adhesives are prepared for use, that is, melted and discharged in measured quantities, in known devices. There are problems which occur in the use or handling of the adhesive materials which are caused by the known devices.

One significant problem involves sealing the inlet for the adhesive material into the melting chamber. While the outlet for the melted adhesive material from the melting chamber is valved, the inlet into the chamber does not have any obstruction so that the adhesive material in solid rod form can be inserted into the chamber. Since the rod-shaped adhesive materials may have different cross-sectional areas, up until the present time sealing sleeves of an elastic material, such as silicon rubber or the like, have been used to provide a seal between the adhesive material and the sleeve as the rod-shaped material is introduced into the melting chamber. These materials which have been used have a poor temperature stability. There has been the tendency in known sealing sleeves for the sleeve material to become brittle, especially that portion of the sealing sleeve which adjoins the melting chamber. Additionally, when the device is turned off, the adhesive material resolidifies and adheres to the inside surface of the sealing sleeve. Such adherence interferes with the movement of the adhesive material into the melting chamber when the device is turned on again.

Instead of using elastic sealing sleeves as in the past, tests have been performed using other materials for the sleeve. One such material which has been particularly useful is polytetrafluoroethylene (PTFE), known as TEFLON, which in addition to good temperature stability has shown a very low tendency to stick to the solidifying adhesive material. The main disadvantage of such a sealing sleeve is its limited elasticity. The difficulties caused by the different cross-sectional sizes of the body of adhesive material can, if at all, be eliminated if the inside diameter of the sealing sleeve is made a little larger than the outside diameter of an average adhesive material rod. When smaller sized rods are used, however, there is the disadvantage that an annular gap forms between the sleeve and the rod. The adhesive material melted in the melting chamber may flow into this annular gap. As a result, when the device is turned off, any adhesive material that has flown into the annular gap solidifies about the adhesive material rod causing an increase in its diameter. When the device is started up again, difficulties develop particularly when advancing the adhesive material toward the melting chamber, because the increased cross-sectional area of the rod of adhesive material cannot pass through the inlet opening into the chamber. The inlet opening cannot be enlarged at random due to heat loss. Since a sealing sleeve formed of the above-mentioned material has a very low heat conductivity, the rod of adhesive material within it remains mainly in the solid state. Accordingly, damage to the feeding mechanism of the device cannot be prevented.

Therefore, it is the primary object of the present invention to provide a device which affords an effective seal of the inlet into the melting chamber and which is wear-resistant and operates without any impairment of its function.

In accordance with the present invention, heating elements are provided on the sealing sleeve where it adjoins the melting chamber so that the adhesive material within the sleeve can be warmed up.

Heating elements may be arranged directly on the sealing sleeve or on other parts so that a limited softening of the solid body of adhesive material within the sealing sleeve is achieved. The limited amount of heat supplied is sufficient to enable the adhesive material to pass into the melting chamber. The required heating capacity is relatively small as compared to that of the heating coil associated with the melting chamber.

Due to the poor heat conductivity of the sealing sleeve, the melted adhesive material only reaches into the area of the annular gap in the sleeve which adjoins the melting chamber. As a result, it is not necessary to heat the entire length of the sealing sleeve, rather it is enough if the heating elements at least partially enclose that portion of the sealing sleeve which adjoins the melting chamber.

Additional heating of the body of adhesive material within the heating sleeve during normal operation is not required and, further, is not desirable. Therefore, it is useful to provide a shut-off device to turn off the heating elements after the desired heat is provided. Accordingly, the heating elements operate only when the device is turned on and until the required warm-up temperature of about 60° C. is reached within the sealing sleeve. When the warm-up temperature is attained, the heating elements are turned off.

There are a number of different possibilities for the construction of the heating elements used with the sealing sleeve. In one advantageous embodiment, the heating elements are formed as jaws which at least partially enclose the sealing sleeve and are connected to the heating coil by bimetallic webs. Heat is conducted through the bimetallic webs to the jaws which contact the sealing sleeve. The webs become heated during the passage of heat to the sealing sleeve. Because of its bimetallic character, the heat transmitted through the web causes it to warp. As the webs warp, the jaws are lifted off the sealing sleeve and the passage of heat to the sleeve is discontinued. When the device is shut off, the webs cool and the jaws return to their original position in contact with the sealing sleeve. When the device is turned on, the heat transfer process and the warping of the webs is repeated. In such a construction there is the advantage that hardly any wear occurs so that the device has a long service life.

Another practical design for transmitting heat to the sealing sleeve involves the use of a temperature switch. Adjustable temperature switches have the advantage that an optimum setting of the switching temperature is possible. Temperature switches are manufactured in large quantities and, accordingly, are very economical elements. If a switch should become defective, it can be easily replaced.

To keep the heating time as short as possible, it is advantageous if the heating elements are in the form of filaments connected with the temperature switch. In this way, the filaments are in continuous contact with the sealing sleeve and are turned on and off by the switch. The heating capacity of a filament is small compared to the heating coil used with the melting chamber. Consequently, the current controlled by the temperature switch is small so that only a small amount of wear occurs at the switch.

Heating of the sealing sleeve should be locally limited as much as is possible. To provide such a feature it is useful if the sealing sleeve has an annular groove encircling its outside surface forming an air gap in the area next to the heating elements but on the side away from the melting chamber. Such an air gap blocks the flow of heat along the sleeve and eliminates any heating of the portion of the sleeve spaced from the melting chamber.

A part of the heat directed into the sealing sleeve flows into that portion of the sleeve close to the opposite end of the sleeve spaced from the melting chamber. To remove this heat as quickly as possible and avoid heating the adhesive material in this region, it is advantageous if the sealing sleeve has a cooling plate about its portion spaced from the melting chamber.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figures 1, 2, 3:
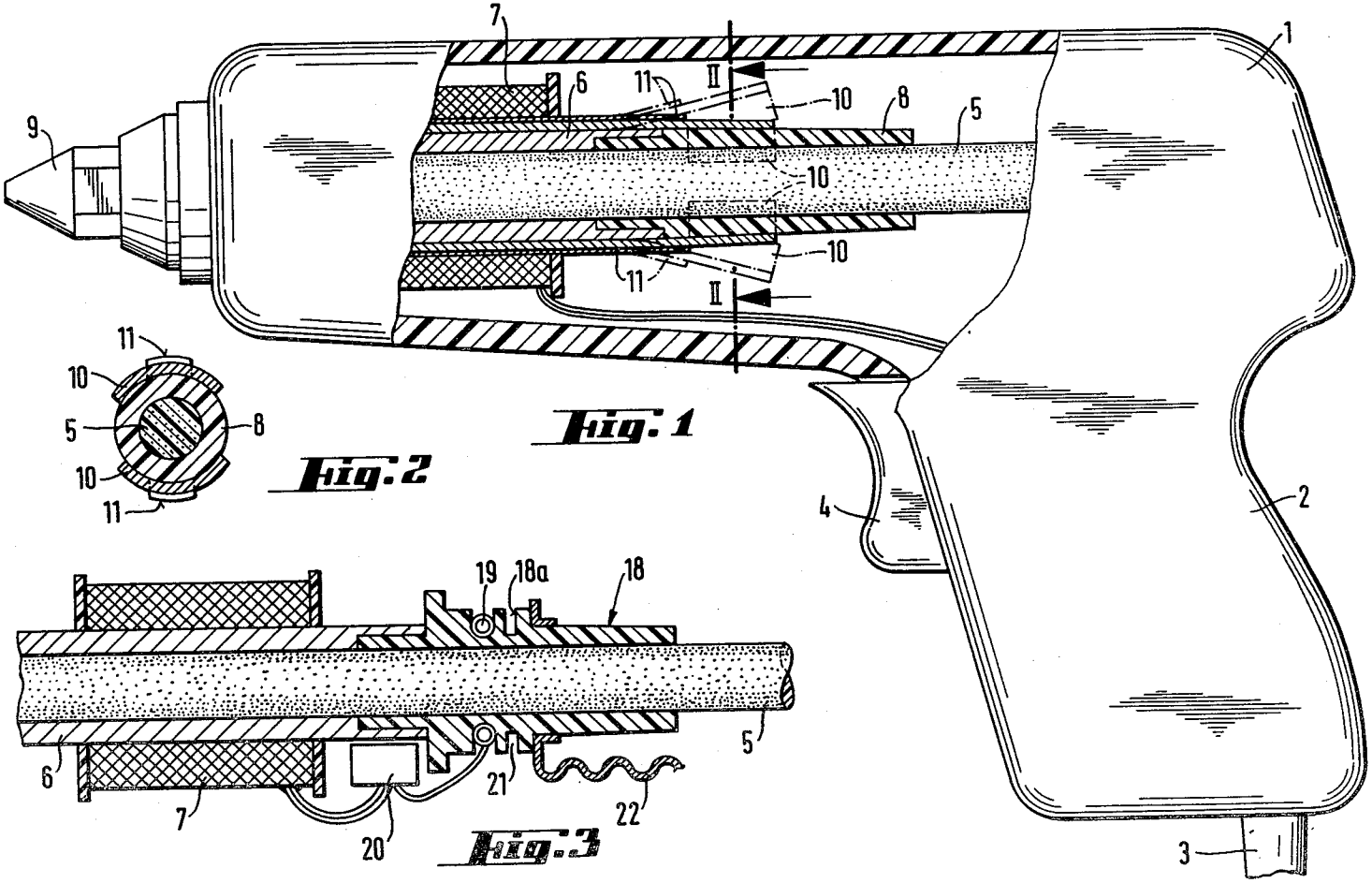
FIG. 1 is a side view, partly in section, of a device embodying a sealing sleeve and means for heating the sealing sleeve.
FIG. 2 is a sectional view of the sealing sleeve taken along the line II—II.
FIG. 3 is a sectional view of the device illustrating another embodiment of the means for heating the sealing sleeve using a heating filament.

In FIG. 1 a device for the melting and measured discharge of a thermoplastic adhesive material is illustrated with a hand gun shaped housing including a handle 2 extending outwardly at one end of the housing. An electrical feed line 3 is connected to the handle which also contains a trigger or pushbutton 4. When the pushbutton is squeezed or depressed it causes a solid rod of the adhesive material to advance into the device. The means used for advancing the rod is known but not shown. Within housing 1 is a melting chamber 6 laterally enclosed by a heating coil 7. Heat from the coil 7 melts the adhesive material 5 within the melting chamber 6. To prevent any leakage of the melted adhesive material out of the inlet end of the melting chamber 6, a sealing sleeve 8 is provided. As can be seen in FIG. 1 the sealing sleeve 8 projects axially outwardly from the inlet end of the melting chamber. The sealing sleeve is formed of a heat-resistant material which has a poorer heat conductivity, such as TEFLON.

When the pushbutton 4 is depressed, the rod of adhesive material 5 is carried by a feed mechanism, not shown, through the sealing sleeve 8 and into the inlet end of the melting chamber 6. The action of the solid rod of adhesive material 5 being forced into the melting chamber causes the melted adhesive material to flow out of the melting chamber and through a nozzle 9 located at the front or left hand end of the housing 1 to the exterior of the device. Because of the pressure generated in the melting chamber, part of the melted adhesive material tends to flow out of the inlet end of the melting chamber and into an annular gap located between the interior surface of the sealing sleeve and the surface of the rod of adhesive material 5. When the device is shut off, the adhesive material within the annular gap solidifies and combines with the solid rod. To prevent any interference with the advance of the solid rod into the melting chamber when the device is turned on again, the portion of the sealing sleeve 8 adjoining the inlet end of the melting chamber is at least partly enclosed by heating elements which serve to warm up the adhesive material within the sleeve. As viewed in FIG. 1, the heating elements are formed as jaws 10 partly laterally enclosing the sealing sleeve 8. Each jaw 10 is connected by a bimetallic web 11 with the heating coil 7 extending around the melting chamber. As a result, a portion of the heat generated in the heating coil is conducted through the webs 11 to the jaws 10. The heat flows from the jaws 10 through the wall of the sealing sleeve 8 to the adhesive material. Due to its bimetallic construction, each web will start to warp as it is heated. The warping action in turn lifts the jaws 10 off the sealing sleeve. In FIG. 1, the position of the webs 11 and the jaws 10 contacting the sealing sleeve 8 are shown in full line while the warped position of the webs and the outwardly displaced positions of the jaws are shown in dot-dash lines. By the appropriate dimensioning of the webs 11 the outward displacement of the jaws 10 can be effected only when the adhesive material within the sealing sleeve 8 has reached the desired temperature. Such automatic control is very simple and not subject to mechanical wear. Further, controls are insensitive to dirt.

In FIG. 2 two oppositely arranged jaws 10 and webs 11 are illustrated. If necessary, for more uniform heat distribution, three or more jaws 10 and webs 11 can be used. The jaws are constructed in the form of segments conforming to the shape of the sleeve for providing the maximum contact surface with the sealing sleeve.

In FIG. 3 another embodiment for heating the sealing sleeve is shown. Only a part of the device illustrated in FIG. 1 is shown in FIG. 3. A melting chamber 6 is laterally enclosed by a heating coil 7 and a sealing sleeve 18 is connected to the inlet or right hand end of the melting chamber and extends axially from it. A solid rod of adhesive material 5 is inserted through the sealing sleeve 18 into the inlet end of the melting chamber. To heat the adhesive material 5 within the sealing sleeve 18, a filament 19 laterally encircles the sealing sleeve adjacent its end joined to the melting chamber. The filament 19 only operates when when the device is being heated. When the required temperature of the adhesive material within the sleeve is reached, the flow of heat from the filament 19 is cut off by a temperature switch 20. If, for any reason, the temperature falls below the required or selected value, current is supplied to the filament and, in turn, it supplies heat into the sealing sleeve until the desired temperature has been reached. It can be noted that the filament 19 is connected via a connecting line to the temperature switch 20 and, in turn, the temperature switch is connected to the heating coil 7 around the melting chamber. Spaced from the filament 19 on the side thereof away from the melting chamber 6 is an annular groove 18*a*. This annular groove 18*a* forms an air gap 21 laterally encircling the sealing sleeve. The groove 18*a* extends inwardly from the outside surface of the sleeve and terminates outwardly from the inside surface of the sleeve. The air gap 21 formed by the groove 18*a* hinders the flow of heat along the sealing sleeve away from the melting chamber. Accordingly, it is possible to prevent the adhesive material from being heated too much within the sealing sleeve. Further, a cooling plate 22 is attached to the exterior of the sealing sleeve for dissipating heat that reaches the portion of the sealing sleeve on the side of the filament 19 extending away from the melting chamber. Any heat passing through the sealing sleeve beyond the air gap 21 is dissipated by the cooling plate 22.

While specific embodiments of the invention have been shown and described in detail to illustrate the application of the inventive principles, it will be understood that the invention may be embodied otherwise without departing from such principles.

What is claimed is:

1. Device for the melting and measured discharge of a thermoplastic adhesive material comprising an axially extending melting chamber having an inlet opening at one end and an outlet opening spaced axially from it at the opposite end, a heating coil enclosing said melting chamber for melting the thermoplastic adhesive material so that it can be discharged from the outlet opening, an axially extending sealing sleeve secured to the inlet end of said melting chamber and extending outwardly therefrom and in general axial alignment therewith, said sealing sleeve arrange to prevent leakage of melted adhesive material out of the inlet opening to said melting chamber, wherein the improvement comprises that sealing sleeve being formed of a material having a significantly lower heat conductivity than the material forming said melting chamber, and having a first end located at the inlet opening of said melting chamber and a second end spaced outwardly away from the inlet opening to said melting chamber, a heating means located about said sealing sleeve between the first and second end thereof outside of said melting chamber and adjacent the inlet end of said melting chamber for heating the adhesive material located within said sealing sleeve so that a limited amount of heat is supplied sufficient for the adhesive material to pass into said melting chamber, said heating means having a heating capacity relatively small as compared to the heating capacity of said heating coil, and said heating means spaced axially from said heating coil.

2. Device, as set forth in claim 1, wherein said heating means comprises a filament in contact with and encircling said sealing sleeve between the first and second ends thereof and adjacent to and spaced from the inlet end of said melting chamber, and a temperature switch connected to said filament for discontinuing the passage of heat from said filament to said sealing sleeve when a desired temperature has been reached.

3. Device, as set forth in claim 1, wherein said sealing sleeve being formed of polytetrafluoroethylene.

4. Device, as set forth in claim 1, wherein said heating means comprise heating elements extending at least partially around said sealing sleeve.

5. Device, as set forth in claim 4, including means connected to said heating elements for discontinuing the flow of heat from the heating elements to the sealing sleeve after a desired temperature has been reached.

6. Device, as set forth in claim 5, wherein said means for discontinuing the flow of heat from the heating elements comprises a temperature switch connected to said heating elements for discontinuing the generation of heat when the desired temperature has been reached.

7. Device, as set forth in claim 1, wherein said sealing sleeve has an annular groove encircling the axis of said sealing sleeve and formed in the outside surface thereof extending inwardly toward and spaced from the inner surface of said sealing sleeve, said annular groove located between the first and second ends of said sleeve and spaced outwardly from the inlet opening to said melting chamber, and said heating means being located between said annular groove and said melting chamber, and said annular groove forming an air space hindering the flow of heat from said heating means through said sealing sleeve toward the end of said sealing sleeve remote from said melting chamber.

8. Device, as set forth in claim 1 or 7, including a cooling plate attached to said sealing sleeve on the portion thereof located between said heating means and the second end of said sealing sleeve, said cooling plate arranged to dissipate heat from the portion of said sealing sleeve on the side of said heating means more remote from said melting chamber.

9. Device for the melting and measured discharge of a thermoplastic adhesive material comprising an axially extending melting chamber having an inlet opening at one end and an outlet opening spaced axially from it at the opposite end, a heating coil enclosing said melting chamber for melting the thermoplastic adhesive material so that it can be discharged from the outlet opening, an axially extending sealing sleeve secured to the inlet end of said melting chamber and extending outwardly therefrom in general axial alignment therewith, said sealing sleeve arranged to prevent leakage of melted adhesive material out of the inlet opening of said melting chamber, wherein the improvement comprises that said sealing sleeve being formed of a material having a significantly lower heat conductivity than the material forming said melting chamber and having a first end located at the inlet opening of said melting chamber and a second end spaced outwardly away from the inlet opening to said melting chamber, a heating means located about said sealing sleeve between the first and second ends thereof outside of said melting chamber and adjacent the inlet end of said melting chamber for heating the adhesive material located within said sealing sleeve so that a limited amount of heat is supplied sufficient for the adhesive material to pass into said melting chamber, said heating means having a heating capacity relatively small as compared to the heating capacity of said heating coil, said heating means spaced axially from said heating coil, said heating means comprise at least one heating element extending at least partially around said sealing sleeve, means connected to said at least one heating element for discontinuing the flow of heat from the heating element to said sealing sleeve after the desired temperature has been reached, said at least one heating element comprises a filament in contact with and encircling said sealing sleeve between the first and second ends thereof adjacent to and spaced axially from the inlet end of said melting chamber, and a temperature switch connected to said filament for discontinuing the passage of heat from said filament to said sealing sleeve when a desired temperature has been reached.

10. Device as set forth in claim 9, wherein said sealing sleeve has an annular groove encircling the axis of said sealing sleeve and formed in the outside surface thereof extending inwardly toward and spaced from the inner surface of said sealing sleeve, said annular groove located between the first and second ends of said sleeve and spaced from said filament toward the second end of said sleeve, and said annular groove forming an air space hindering the flow of heat from said filament through said sealing sleeve toward the second end of said sealing sleeve.

11. Device, as set forth in claim 10, including a cooling plate attached to said sealing sleeve on the portion thereof located between said filament and the second end of said sealing sleeve, and said cooling plate arranged to dissipate heat from the portion of said sealing sleeve on the side of said filament more remote from said melting chamber.

12. Device for the melting and measured discharge of a thermoplastic adhesive material comprising an axially extending melting chamber having an inlet opening at one end and an outlet opening spaced axially from it at the opposite end, a heating coil enclosing said melting chamber, an axially extending sealing sleeve secured to the inlet end of said melting chamber and extending outwardly therefrom and in general axial alignment therewith, wherein the improvement comprises that a heating means is provided on said sealing sleeve adjacent the inlet end of said melting chamber for heating the adhesive material located within said sealing sleeve, said heating means comprise heating elements at least partially enclosing said sealing sleeve, means connected to said heating element for discontinuing the flow of heat from the heating elements to the sealing sleeve after a desired temperature has been reached, said heating elements comprises a plurality of jaws, a bimetallic web connected to each said jaw and to said heating coil with said bimetallic webs arranged to warp as the temperature applied to said heating elements increases for displacing said heating elements outwardly from said sealing sleeve and discontinuing the flow of heat from said heating elements to said sealing sleeve.

* * * * *